United States Patent [19]

Nakada et al.

[11] Patent Number: 4,587,878

[45] Date of Patent: May 13, 1986

[54] AUTOMATIC PERFORMING APPARATUS AND DATA RECORDING MEDIUM THEREFOR

[75] Inventors: Akira Nakada; Takatoshi Okumura; Kotaro Mizuno, all of Hamamatsu, Japan

[73] Assignee: Nippon Gakki Seizo Kabushiki Kaisha, Hamamatsu, Japan

[21] Appl. No.: 626,610

[22] Filed: Jul. 6, 1984

Related U.S. Application Data

[63] Continuation of Ser. No. 390,793, Jun. 21, 1982, abandoned.

[30] Foreign Application Priority Data

Jun. 27, 1981 [JP] Japan ..... 56-100000
Jun. 27, 1981 [JP] Japan ..... 56-99999

[51] Int. Cl.[4] ..... G10F 5/00; G10G 3/04; G10H 1/38; G10H 1/42

[52] U.S. Cl. ..... 84/1.03; 84/1.28; 84/115; 84/462; 84/DIG. 12; 84/DIG. 22; 84/DIG. 29

[58] Field of Search ..... 84/1.01–1.03, 84/1.28, 115, 462, DIG. 12, DIG. 22, DIG. 29

[56] References Cited

U.S. PATENT DOCUMENTS

| | | | |
|---|---|---|---|
| 3,781,452 | 12/1973 | Vauclain | 84/1.28 |
| 3,890,871 | 6/1975 | Oberheim | 84/1.01 |
| 4,339,978 | 7/1982 | Imamura | 84/1.03 |
| 4,472,992 | 9/1984 | Okuma et al. | 84/1.03 |

OTHER PUBLICATIONS

25 *Journal of the Patent Office Society* 904, Ex Parte S (Board of Appeals) Aug. 4, 1943 (Case No. 109).

*Primary Examiner*—S. J. Witkowski
*Attorney, Agent, or Firm*—Spensley Horn Jubas & Lubitz

[57] ABSTRACT

An automatic performing apparatus for use in an electronic musical instrument stores chord name data and chord generation timing data to carry out an automatic chord performance. In spite of frequent variations of a chord during the progression of a music piece, repetitive storage of a same chord name data is not required so that the amount of stored data can be reduced, allowing utilization of a memory of a small capacity.

26 Claims, 10 Drawing Figures

AUTOMATIC PERFORMING APPARATUS AND DATA RECORDING MEDIUM THEREFOR

This application is a continuation of Ser. No. 390,793 filed June 21, 1982, now abandoned.

BACKGROUND OF THE INVENTION (a) Field of the Invention

The present invention relates to an automatic performing apparatus for use in an electronic musical instrument, which apparatus being capable of making automatic chord performance based on the data which have been recorded in advance. The present invention is intended to reduce the amount of data by recording chord generation timing data as well as the chord name data with respect to those chords which are to be generated.

(b) Description of the Prior Art

As the prior art automatic performing apparatuses of this type, there has been known an apparatus arranged so that chord name data are recorded in the order of generation of chords as a music to be played progresses, and that these recorded chord name data are read out successively, to thereby make automatic chord performance. Such prior art apparatus has been disclosed, for example, in Japanese Utility Model Preliminary Publication Nos. Sho 50-925 and Sho 50-926.

According to such conventional system of automatic performance, however, there has been the inconvenience such that, in case there frequently or irregularly take place variations of chords during the progression of a music being played, the amount of such data as are required to be recorded becomes enormous, and that accordingly there have been required to provide external recording medium and/or internal memory of large capacities.

SUMMARY OF THE INVENTION

It is, therefore, a primary object of the present invention to provide an automatic performing apparatus performing an automatic chord performance by relatively small data.

A second object of the present invention is to provide an automatic performing apparatus of the type as described above, which can be operated using an internal memory of small capacity.

A third object of the present invention is to provide an automatic performing apparatus of the type as described above, which is arranged so that, even in case the music being played is such that there frequently occur variations of chords during the progress of a music being played, there is no need to store or record the same chord name data repetitively.

A fourth object of the present invention is to provide an automatic performing apparatus of the type as described above, which is arranged so that, even in case there occur irregular variations of chords during the progression of a music being played, there is no need to store or record the same chord name data repeatedly.

A fifth object of the present invention is to provide data recording medium for an automatic performing apparatus which records chord name data and chord generation timing data to make the apparatus perform an automatic chord performance.

BRIEF DESCRIPTION OF THE DRAWINGS

FIGS. 1 and 2 show a first embodiment of the present invention, in which:

FIG. 1 is a format diagram of data for automatic performance which is to be recorded on a musical score sheet.

FIG. 2 is a circuit diagram of the automatic performing apparatus utilizing the musical score sheet.

FIGS. 5 and 6 show a second embodiment of the present invention, in which:

FIG. 5 is a format diagram of data for automatic performance which is to be recorded on a musical score sheet.

FIG. 6 is a circuit diagram of the automatic performing apparatus utilizing the musical score sheet.

FIGS. 9 and 10 show a third embodiment of the present invention, in which:

FIG. 9 is a format diagram of data for automatic performance which are to be recorded on a musical score sheet.

FIG. 10 is a circuit diagram of the automatic performing apparatus utilizing the musical score sheet.

DETAILED DESCRIPTION OF THE PREFERRED EMBODIMENTS

Figure 1:
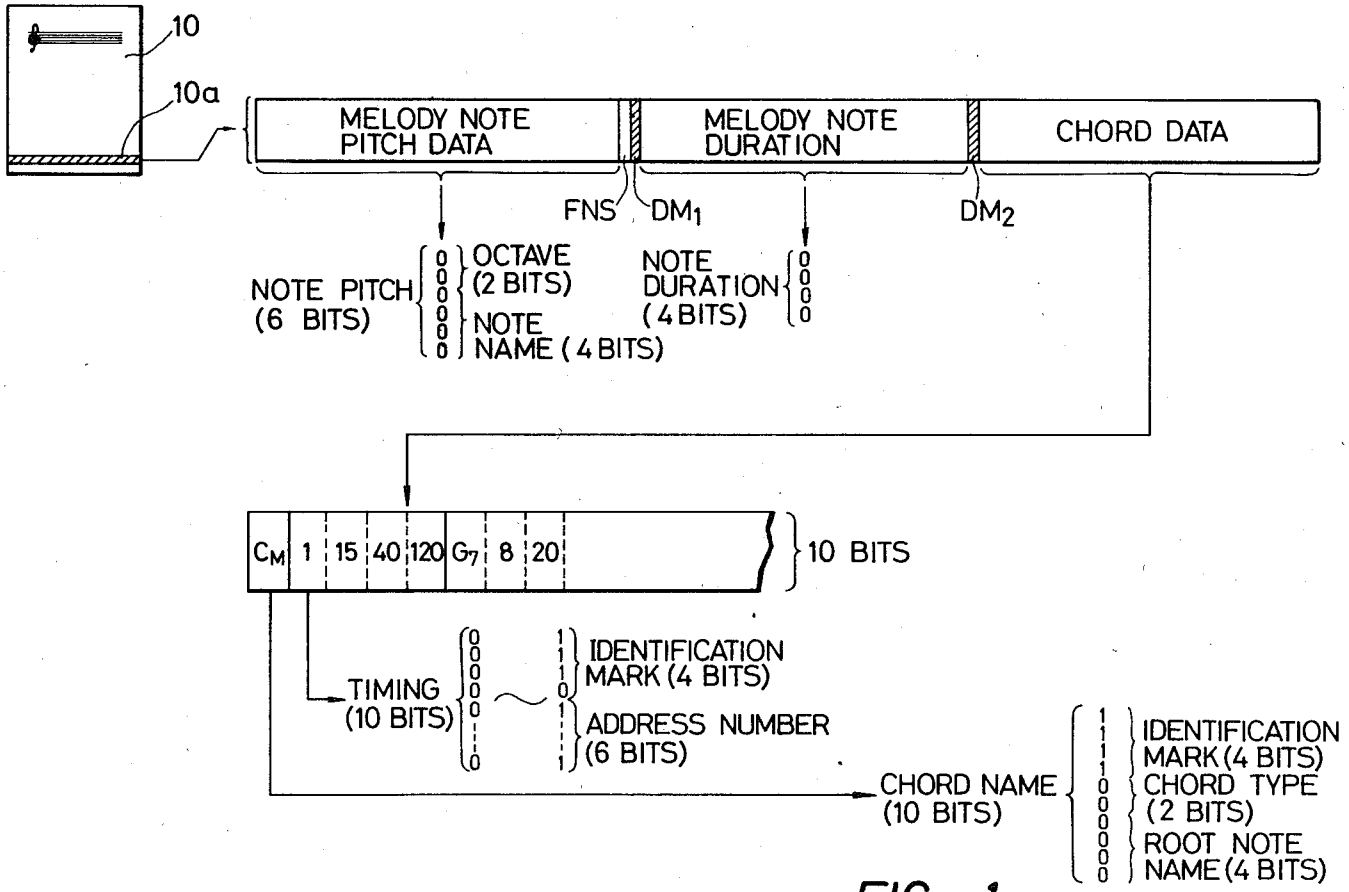

FIG. 1 shows a format of automatic performance data which is to be recorded on a musical score sheet which serves as a recording medium for automatic performance according to a first embodiment of the present invention.

In the lower blank portion of a musical score sheet 10, there is provided a data recording section 10*a*. In this data recording section 10*a*, a one-track magnetic tape, for example, is bonded by an appropriate means to the musical score sheet 10. On the magnetic tape are magnetically recorded, in the form of serial data, melody note pitch data corresponding to the contents of the melody presented on the score sheet 10, finish data FNS, demarcation data $DM_1$, melody note duration data corresponding to the contents of the melody presented on the score sheet 10, demarcation data $DM_2$, and chord data corresponding to the contents of the chords presented on the score sheet 10, in accordance with this order.

The melody pitch data shows the pitches of a melody by a 6-bit binary code for each musical note of a melody. Among these 6 bits, the significant 2 bits represent an octave, and the less significant 4 bits indicate a note name. The melody note pitch data corresponding to the respective melody notes are arrayed in the order of generation of sounds in accordance with the progression of the melody. At the locations corresponding to rests in said array of notes, there are disposed rest note data which is comprised of a 6-bit binary code "1 1 1 0 0 0".

The finish data FNS is comprised of a 6-bit binary code "1 1 0 0 0 0", and this data designates the finish of the melody. Also, the demarcation data $DM_1$ is comprised of a 6-bit binary code "1 1 0 1 0 0" and indicates the boundary between the finish data FNS and the initial melody note duration data.

The melody note duration data represents the duration of either a musical note or the duration of each rest note during the course of progression of a melody i.e. it represents the duration of the musical note. It is comprised of a 4-bit binary code. On the other hand, the demarcation data $DM_2$ is comprised of a 4-bit binary code, and indicates a boundary between the final melody note duration data and the initial chord data.

Chord data includes chord name data indicating the name of the chord which is to be generated, and also timing data indicating the timing of generation of such chord. Both the chord name data and the timing data are each comprised of a 10-bit binary code. The chord data is of the arrangement that its significant 4 bits are "1" and indicate identifying mark, and among the remaining 6 bits, the significant 2 bits represent such chord type as major or seventh, and the remaining 4 bits indicate the name of a root note such as C or G so that said 6 bits represent the name of a chord such as C-major ($C_M$) and G-seventh ($G_7$). The less significant 6 bits of the chord name data are variable from the state of all bits being "0" to the state of all bits being "1". Accordingly, the chord name data is able to indicate different names of chords in number corresponding to 960 through 1023 in term of decimal notation.

Timing data is such that its significant 4 bits represent an identifying mark, and the other 6 bits indicate such address numbers as "1", "15" and "40" as are shown in FIG. 1 with respect to $C_M$. The address number in this case corresponds to that address number which is read out in accordance with the progress of a melody from a memory provided in an automatic performing apparatus after the aforesaid melody note pitch data has been transferred once to said memory, and this address number instructs the timing at which a chord is to be generated. The significant 4-bits of the timing data is variable from "0 0 0 0" to "1 1 1 0" and, therefore, the identifying mark code, unlike the instance of the above-mentioned chord name data, is not constant. Also, the less significant 6 bits of the timing data are variable from "0 0 0 0 0 0" to "1 1 1 1 1 1". Accordingly, the timing data is capable of expressing different address numbers in correspondence to 0 through 959 in term of decimal notation.

It should be understood that, with respect to the chord data, the identification bit may be comprised of a single bit (for example, the chord name data may be "1" and the timing data may be "0"), and the remaining 9 bits may be used to express the chord names or address numbers. In case of such arrangement, it is possible to express different chord names or different address numbers corresponding to 0 through 511 in term of decimal notation. Also, with respect to the chord name data, arrangement may be made that the chord type bit may be comprised of 3 or more bits so as to express further many chord types. Further, the recording order of the respective data on to the recording medium is not limited to the example shown. Such order may be easily altered by using appropriate demarcation marks.

Next, by referring to FIG. 2, description will be made of the automatic performing apparatus which utilizes the score sheet shown in FIG. 1. The lower portion of the music score sheet 10 is inserted into an inlet of a data read-out unit 12. Whereupon, the data read-out unit 12 reads out sequentially the automatic performing data recorded on the data recording section 10*a*, and supplies in serial form the data to a RAM (Random Access Memory) write-in controlling circuit 14.

Figure 3:
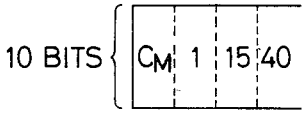
FIGS. 3 and 4 are illustrations for explaining the data format converting operations carried out in the circuit of FIG. 2.
Figure 4:
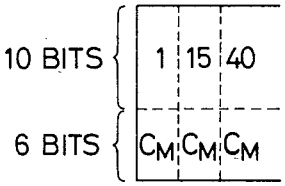

The RAM write-in controlling circuit 14 supplies the 6-bit serial melody note pitch data to a serial/parallel (S/P) converting circuit 16 which, in turn, supplies the 6-bit parallel data to a note pitch data RAM 18. Following the write-in of these parallel data in the RAM 18 in accordance with a write-in address signal $WA_1$, and upon completion of the write-in of the melody note pitch data, a finish data FNS is written in this RAM in the same manner. Next, the RAM write-in controlling circuit 14, after having detected a demarcation mark data $DM_1$, supplies the 4-bit serial melody note duration data to an S/P converting circuit 20 which produces the 4-bit parallel data to write this data in a note duration data RAM 22 in accordance with a write-in address signal $WA_2$. And, upon completion of the write-in of the melody note duration data, the RAM write-in controlling circuit 14 detects the demarcation data $DM_2$, and thereafter it supplies the chord data, in the form of a 16-bit parallel data, to a chord data RAM 28 via an S/P converting circuit 24 and via a data format converting circuit 26, and writes the data in this RAM 28 in accordance with a write-in address signal $WA_3$. In such instance, the S/P converting circuit 24 converts the 10-bit serial chord data to 10-bit parallel chord data, and the data format converting circuit 26 converts the 10-bit parallel chord data to 16-bit parallel chord data as shown, by way of example, in FIGS. 3 and 4. More particularly, to the input side of the data format converting circuit 26 are supplied in succession the parallel 10-bit data comprising the mark data and the chord name data indicating chord name $C_M$ or the timing data indicating the timings of generation of the chord $C_M$ in correspondence to the address numbers "1", "15", "40", . . . , as shown in FIG. 3. However, at the output side of the data format converting circuit 26 are sequentially delivered out 16-bit parallel chord data which comprises parallel 10-bit timing data corresponding to the address numbers "1", "15", "40", . . . , each being accompanied by the 6-bit chord name data indicating the chord name $C_M$ as shown in FIG. 4. The parallel 6-bit chord name data shown in FIG. 4 corresponds to the parallel 10-bit chord name data shown in FIG. 3 after having been removed of the 4-bit identifying mark bits therefrom.

It should be noted here that the data amount of the chord is far smaller according to the present invention than those of the melody note pitch and the melody note duration and that the memory capacity of the RAM 28 is accordingly smaller than those of the RAMs 18 and 22. This enables a high-speed or short time read-out operation of the RAM 28 which will be described later. The read-out of the melody data from the RAMs 18 and 22 is controlled by a read-out controlling circuit 30, whereas the read-out of chord data from the RAM 28 is controlled by a searching circuit 32.

In the read-out controlling circuit 30, when a start switch SW is turned "on", an R-S flip-flop 34 is set, and its output Q="1" is supplied to an inverter 36 and to a differential circuit 38. This inverter 36 generates an output signal $\overline{PLAY}$="1" during the non-performance period. Accordingly, its output signal $\overline{PLAY}$ becomes "0" in accordance with the output Q="1" of the flip-flop 34. Also, the differential circuit 38 generates a start signal ΔSTRT by making a build-up differentiation of the output Q="1" of the flip-flop 34 in synchronism with a system clock signal $\phi$.

The start signal ΔSTRT is supplied, as a clock input CK, via an OR gate 40 to an address counter 42 which has been reset by the signal $\overline{PLAY}$. Accordingly, the counter 42 generates a read-out address signal $RA_1$ corresponding to the initial read-out address in response to the start signal ΔSTRT. From the RAM 18 is read out a melody note pitch data corresponding to a first melody tone in accordance with the abovesaid address signal $RA_1$, and it is supplied to a key depression display unit 44 and also to a melody tone generating circuit 46. As a result, the key depression display unit 44 displays a specific key corresponding to the initial melody tone by, for example, a light-emitting device which is provided on either the keyboard or a keyboard diagram. Also, the melody tone generating circuit 46 performs an electronic synthesis of a musical tone signal corresponding to the initial melody tone and supplies same, via an output amplifier 48, to a loudspeaker 50. As a result, the initial melody tone is sounded from the loudspeaker 50.

An address counter 52, after having been reset by the signal $\overline{PLAY}$, generates a read-out address signal $RA_2$ corresponding to the initial read-out address in response to the start signal ΔSTRT. In accordance with this read-out address signal $RA_2$, there is read out from the RAM 22*a* melody note duration data corresponding to the initial melody note, and it is supplied as one of the comparison inputs, via a duration data converting circuit 54, to a comparing circuit 56. The duration data converting circuit 54 is comprised of, for example, an ROM (Read Only Memory). This circuit 54 generates such conversion output as will indicate the duration of a note or rest shown by the melody note duration data delivered from the RAM 22, to correpond to the count value of a tempo clock signal TCL which is generated by a tempo clock supply 58.

A note duration counter 60 counts the tempo clock signals TCL after being reset by the start signal ΔSTRT delivered from an OR gate 62, and supplies its count output to the comparing circuit 56 as the latter's other comparison input. As a result, the comparing circuit 56 compares the two comparison inputs, and when the count value of the counter 60 reaches a value corresponding to the note duration of the initial melody note, it generates a coincidence signal EQ.

This coincidence signal EQ serves to reset the counter 60 via a D-flip-flop 64 which is timed by a system clock signal $\phi$ and further through the OR gate 62. The counter 60, after reset, again performs counting of the tempo clock signals TCL. Also, the coincidence signal EQ is supplied via an OR gate 40 to a counter 42. Therefore, the counter 42 advances by one count and generates a read-out address signal $RA_1$ corresponding to a second read-out address. As a result, a melody note pitch data corresponding to the second melody tone is read out from the RAM 18, and it is supplied to a key depression display unit 44 and to a melody tone generating circuit 46. Accordingly, in the key depression display unit 44, there is performed a display corresponding to the second melody tone and concurrently therewith, in the melody tone generating circuit 46, there is carried out a synthesis of musical tone signals corresponding to the second melody tone. And, from the loudspeaker 50 is sounded the second melody tone.

The coincidence signal EQ delivered from the comparing circuit 56 is supplied, via the OR gate 40, to the counter 52 also. Therefore, the counter 52 generates a read-out address signal $RA_2$ which corresponds to the second read-out address. As a result, there is read out from the RAM 22 a melody note duration data corresponding to the second melody sound, and it is supplied, via the duration data converting circuit 54 to the comparing circuit 56. At such instance, the comparing circuit 56 is supplied also with the count output of the counter 60. Accordingly, this comparing circuit 56 performs a comparing operation as mentioned before. When the count value of the counter 60 reaches a value corresponding to the note duration of the second melody tone, this comparing circuit 56 again generates a coincidence signal EQ. Subsequently therefrom, in a manner same as that described above, a coincidence signal EQ is generated for each completion of determination of a note duration or rest duration. And, upon each generation of a coincidence signal EQ, there is freshly read out another melody data, and on the basis of this read-out data, there are performed an automatic key depression display and an automatic melody performance.

Finally, a finish data FNS is read out from the RAM 18, and it is supplied to a finish detecting circuit 66. This finish detecting circuit 66, upon its detection of a finish data FNS, resets the flip-flop 34 by its own detection signal. Whereby, a series of melody data read-out completes.

The melody data read-out operation has been described above. Concurrently therewith, a read-out of chord data is performed, in a manner as will be described below.

In the searching circuit 32, an R-S flip-flop 68 is arranged to be set in response to a search command signal SI which is comprised of the output signal of said OR gate 40. This search command signal SI is adapted to reset an address counter 70 which counts the system clock signal $\phi$. When a start signal ASTRT is generated, a search command signal SI which is comprised of this start signal ΔSTRT sets the R-S flip-flop 68 on the one hand, and it resets the counter 70 on the other hand. The counter 70 counts the system clock signal $\phi$ after said resetting, and supplies a read-out address signal $RA_3$ to the RAM 28. As a result, a chord data is read out at a high speed from the RAM 28.

Among those chord data which are read out at such instance, the timing data TD is supplied to a comparing circuit 72 as one of its comparison inputs, whereas the chord name data CD is supplied to a latching circuit 74. And, as the other comparison input of the comparing circuit 72, there is supplied from the counter 42 a melody progress data (read-out address signal $RA_1$) which indicates the initial read-out address number. As a result, the comparing circuit 72 generates a coincidence signal EQ when it compares these two inputs and finds out that there is a coincidence therebetween. As mentioned with respect to FIGS. 3 and 4, let us here assume that the initial read-out data delivered from the RAM 28 designates a chord name $C_M$ and also designates the address number "1". Then, the comparing circuit 72 will generate a coincidence signal EQ when the first data is read out from the RAM 28 and it supplies same to an AND gate 76*a*. At such time, the AND gate 76*a* has been enabled by an output Q="1" of the flip-flop 68. Accordingly, the coincidence signal EQ delivered from the comparing circuit 72 is supplied, as a load signal LD, to the latching circuit 74 via the AND gate 76*a*. As a result, the latching circuit 74 latches the chord name data indicating the chord name $C_M$, and supplies same to an accompaniment tone generating circuit 76.

Based on the initial chord name data delivered from the latching circuit 74, the accompaniment tone generating circuit 76 performs an electronic synthesis of a chord tone signal corresponding to the notes of the chord $C_M$ on the basis of the initial chord name data, and a bass tone signal which complies with the chord $C_M$ and a selected rhythm, and supplies them via the output amplifier 48 to the loudspeaker 50. Accordingly, there are generated from the loudspeaker 50 the said initial melody tone together with the chord tone $C_M$ and a bass tone corresponding thereto.

On the other hand, a tempo counter 78 which has been reset by a signal $\overline{\text{PLAY}}$ counts tempo clock signals TCL, and supplies its count output to a rhythm pattern memory 80. Thus, a rhythm pattern signal RP corresponding to a selected rhythm and an accompaniment timing signal AT are generated from the memory 80. The accompaniment timing signal AT is supplied to an accompaniment tone generating circuit 76 so as to be used to control the delivery timing of the chord signal and the bass tone signal in link with the rhythm. Also, the rhythm pattern signal RP is supplied to a rhythm tone generating circuit 82 to drive an appropriate rhythm sound source to thereby cause this rhythm tone generating circuit 82 to generate a rhythm tone signal. This rhythm tone signal delivered from said rhythm tone generating circuit 82 is supplied also to the loudspeaker 50 through an output amplifier. Accordingly, a rhythm tone is sounded also from the loudspeaker 50.

Now, when the count of the counter 70 attains a count value corresponding to the final addresses of the RAM 28, i.e. when the high-speed read-out of chord from RAM 28 completes for one cycle, the counter 70 generates a carry-out output CO to reset the flip-flop 68.

Next, when the comparing circuit 56 generates an initial coincidence signal EQ in correspondence to the second melody note, this coincidence EQ is supplied, as a search command signal SI, to the searching circuit 32. Accordingly, the flip-flop 68 is again set, and the counter 70 will, after being reset, resume the counting of the system clock signal $\phi$. As a result, there is performed a high-speed read-out of data from the RAM 28 in a manner similar to that for the preceding instance described above. Accordingly, the comparing circuit 72 finds out whether or not a timing data TD corresponding to the address number "2" is read out from the RAM 28. In case, however, there is present no timing data TD corresponding to the address number "2", the chord name data in the latching circuit 74 is not renewed. Therefore, the loudspeaker 50 remains to be generating the chord $C_M$ and a base tone corresponding thereto. In a manner mentioned above, the contents of the chord data RAM 28 are searched by the searching circuit 32 each time when the address signals $RA_1$ and $RA_2$ for the melody note RAMs are stepped to advance.

When such operations as described above are repeated and there arrives the time at which the counter 42 supplies to the comparing circuit 72 a data corresponding to the address number "8", the comparing circuit 72 determines, in such manner as it did previously, whether or not a timing data corresponding to the address number "8" is read out from the RAM 28. At this part of operation, let us now assume that there is present a timing data TD corresponding to the address number "8" in correspondence to the chord name $G_7$ as shown by way of example in FIG. 1. The comparing circuit 72 will generate a coincidence signal EQ. Therefore, in accordance with this coincidence signal EQ, the latching circuit 74 will latch a chord name data CD which indicates the chord name $G_7$. As a result, there will be produced from the loudspeaker 50 a chord of $G_7$ and its corresponding bass tone in lieu of the chord $C_M$ and a bass tone corresponding thereto.

Figure 2:
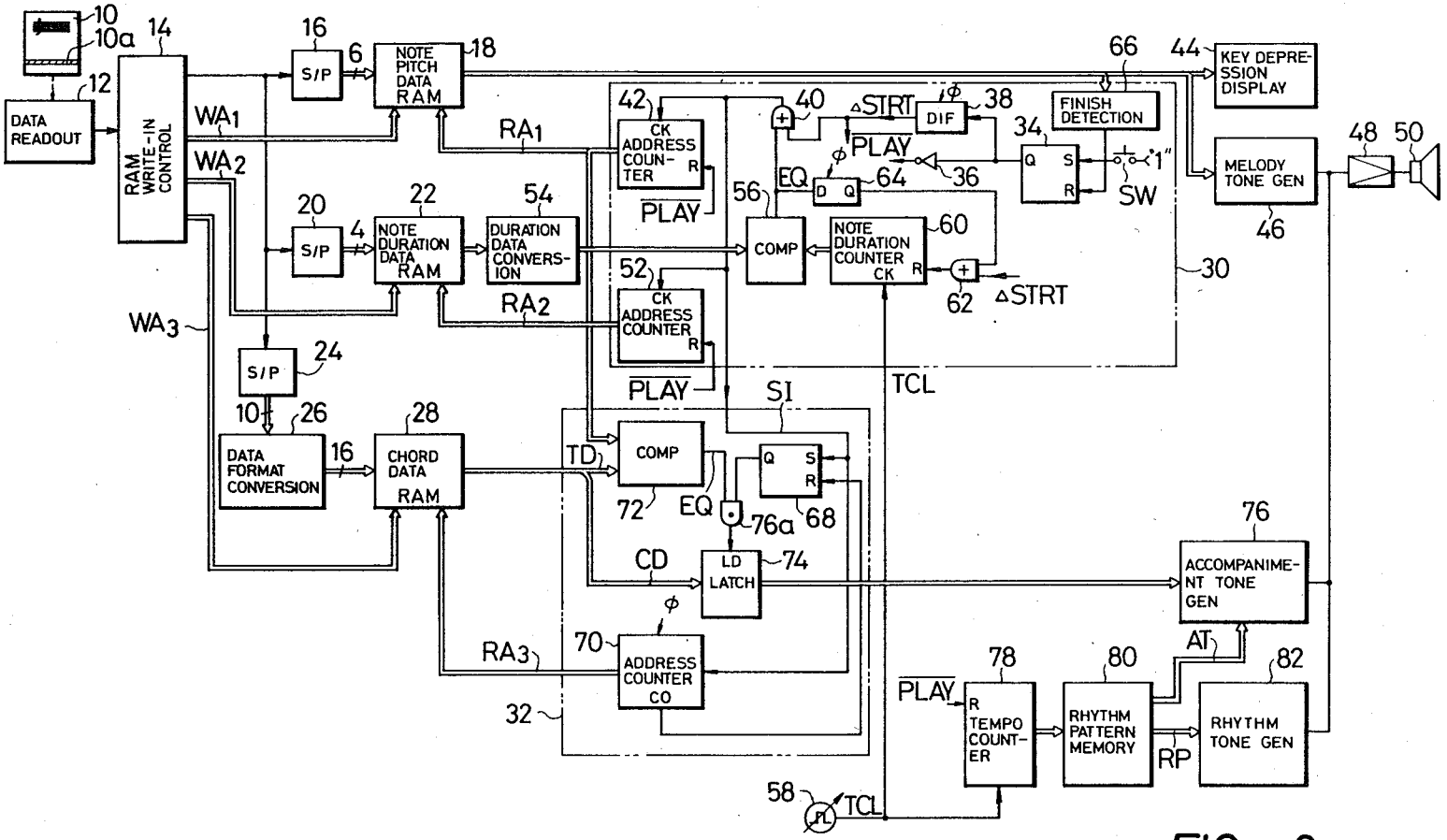

As stated above, according to the automatic performing apparatus shown in FIG. 2, there are automatically carried out a display of a melody key depression, a melody performance and a chord-and-bass performance based on the melody note pitch data, the melody note duration data and the chord data which are transmitted from the music sheet 10 to the RAMs 18, 22 and 28, respectively, and also an automatic rhythm performance can be utilized. Thus, this is extremely advantageous and useful for execising a performance and also for playing a music in ensemble.

Figure 5:
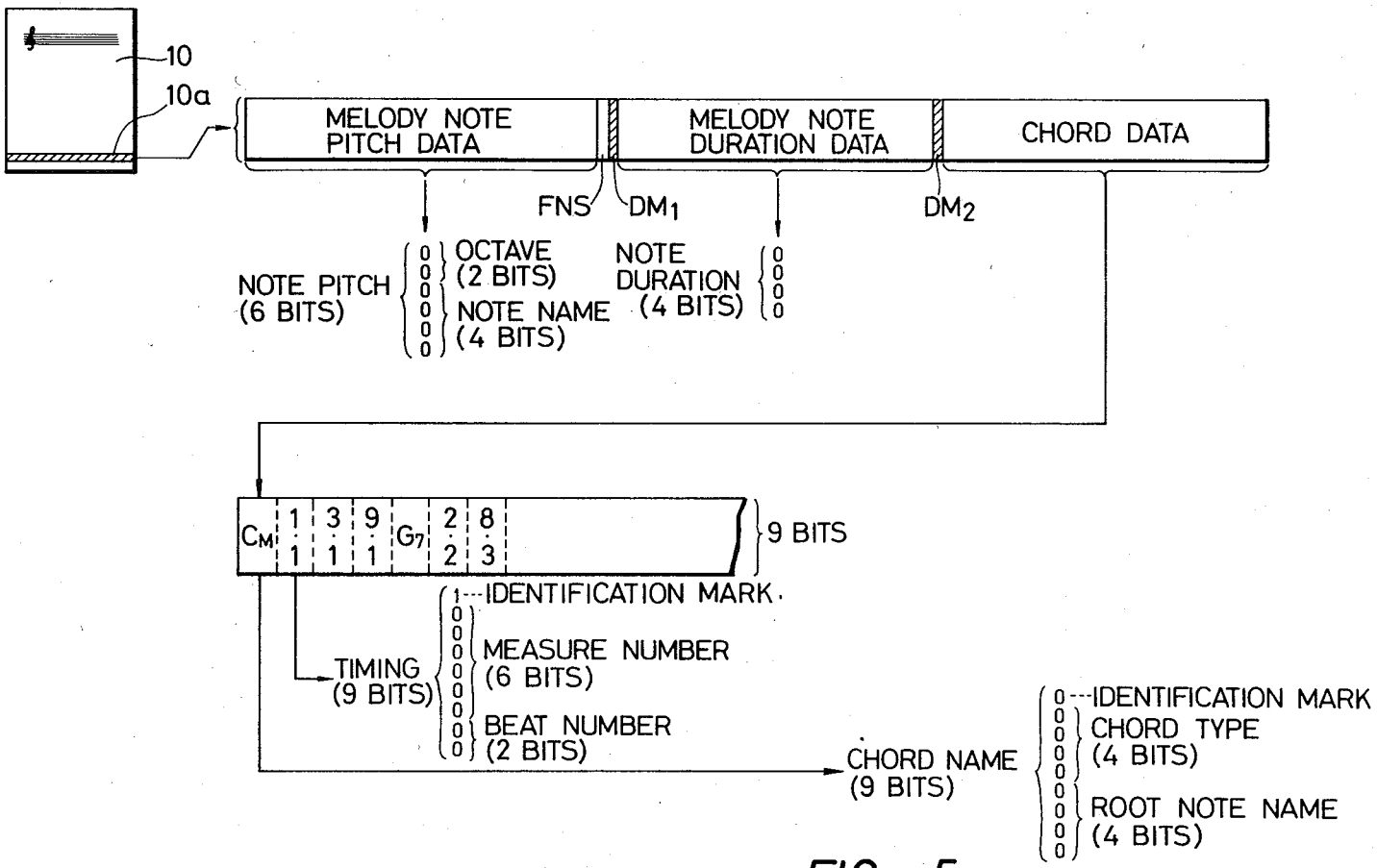

FIG. 5 shows a format of an automatic performance data recorded on a music sheet 10 according to the second embodiment of the present invention. What this format according to the second embodiment differs from the format according to the first embodiment lies in the manner of expressing chord data. The remainder constitution is the same as the first embodiment. More particularly, the chord data which is recorded on the data recording section 10*a* of the music sheet 10 contains chord name data and timing data which each is comprised of a 9-bit binary code. The chord name data is such that the most significant bit is "0" serving as an identifying mark, and that the remaining 8 bits are such that the significant 4 bits thereof expresses a chord type and the remaining 4 bits designate a root note name, whereby they represent such chord names as $C_M$ and $G_7$. Also, the timing data is such that the most significant bit is "1" serving as an identifying mark, whereas the significant 6 bits of the remainder 8 bits are used to designate a measure number, and the other 2 bits express a beat number, whereby they indicate the timing of generation of a chord in such form as the first beat of the first measure (1·1), and the first beat of the third measure (3·1).

Figure 6:
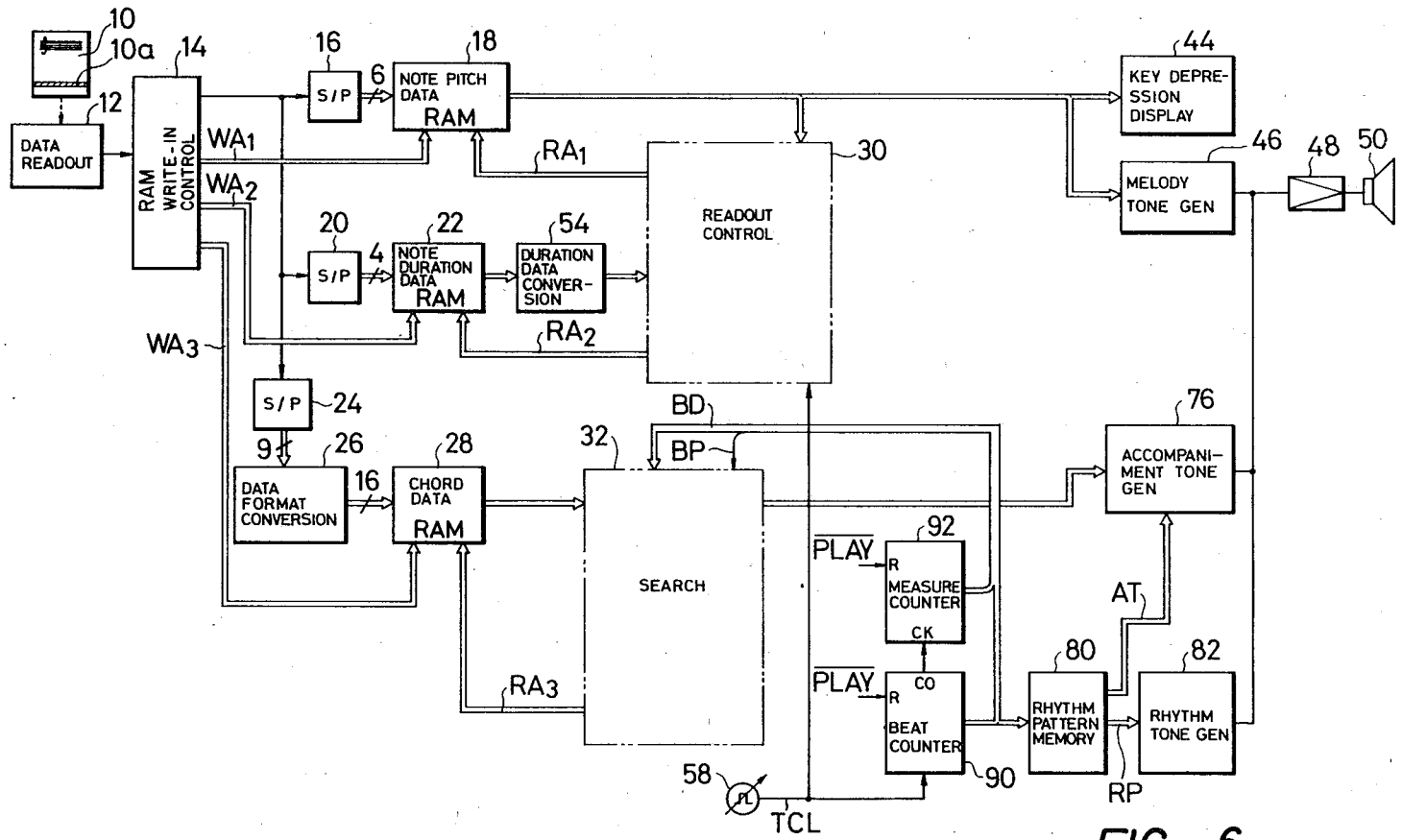

FIG. 6 shows an automatic performing apparatus utilizing the music sheet shown in FIG. 5. In FIG. 6, those parts similar to those shown in FIG. 2 are assigned with like reference numbers and symbols, and their explanation is omitted.

Figure 7:
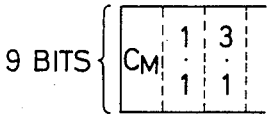
FIGS. 7 and 8 are illustrations for explaining the data format converting operations carried out in the circuit of FIG. 6.
Figure 8:
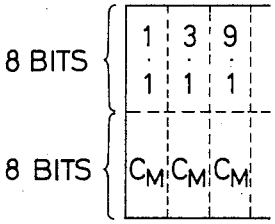

An S/P converting circuit 24 converts a 9-bit serial chord data to a 9-bit parallel chord data, and supplies same to a data format converting circuit 26. The data format converting circuit 26 converts 9-bit parallel chord data to 16-bit parallel chord data as shown in FIGS. 7 and 8. More particularly, to the input side of the data format converting circuit 26 are supplied sequentially chord name data indicating a chord name $C_M$ and the timing data indicating the timing of generation of the chord in correspondence to the measure-beat numbers "1·1", "3·1", . . . , both as parallel 9-bit data, respectively, as shown in FIG. 7. However, at the output side of the format converting circuit 26 are delivered out sequentially 16-bit parallel chord data each comprising parallel 8-bit chord name data indicating a chord name $C_M$ and the parallel 8-bit timing data corresponding to the measure-beat numbers "1·1", "3·1", . . . as shown in FIG. 8. The respective 8-bit timing data and chord name data shown in FIG. 8 correspond to the respective 9-bit timing data and chord name data shown in FIG. 7 which are each removed of 1-bit identifying mark bit therefrom.

A counter 90 is intended to count tempo clock signal TCL after reset by a signal $\overline{\text{PLAY}}$, and is arranged to supply to a rhythm pattern memory 80 a count output corresponding to the beat number. Also, the counter 90 is arranged to supply a carry-out output CO to a measure counter 92 each time when a count value corresponding to one measure is attained. The measure counter 92 counts, after reset by a signal $\overline{PLAY}$, the carry-out outputs CO and generates a count output corresponding to the measure number.

The count outputs of the counters 90 and 92 are combined together to constitute a measure-beat number data BD, and the combined signal is supplied to a searching circuit 32 as a progress data indicative of the progress of the musical composition, in lieu of the progress data $RA_1$ shown in FIG. 1. Also, among the count outputs of the counter 90, the beat pulse BP which is generated for each beat is supplied to the searching circuit 32 as a search command signal in lieu of the search command signal SI shown in FIG. 1.

The searching circuit 32 reads out, at a high speed, the chord data delivered from the RAM 28, in a manner similar to that described above, for each generation of a beat-pulse BP, and compares it with the measure-beat number data BD, and thereby determines whether or not a timing data corresponding to the measure-beat number indicated by the data BD is read out from the RAM 28. As shown by way of example in FIGS. 7 and 8, let us assume here that there is a timing data corresponding to the first beat of the first measure "1·1". The searching circuit 32, when the abovesaid timing data is read out, latches a chord name data indicative of a chord name $C_M$, and supplies it to an accompaniment tone generating circuit 76. Therefore, a loudspeaker 50 generates a chord $C_M$ and its corresponding bass tone in a manner similar to that described previously.

Thereafter, at the arrival of the timing corresponding to the second beat of the second measure, there is read out from the RAM 28 a timing data indicative of the corresponding timing "2·2" as shown in FIG. 5. Whereupon, the searching circuit 32 picks up a chord name data which is indicative of a chord name $G_7$ and supplies same to the accompaniment tone generating circuit 76. As a result, from the loudspeaker 50 is generated the chord $G_7$ and its corresponding bass tone in lieu of the chord $C_M$ and its corresponding bass tone.

Figure 9:
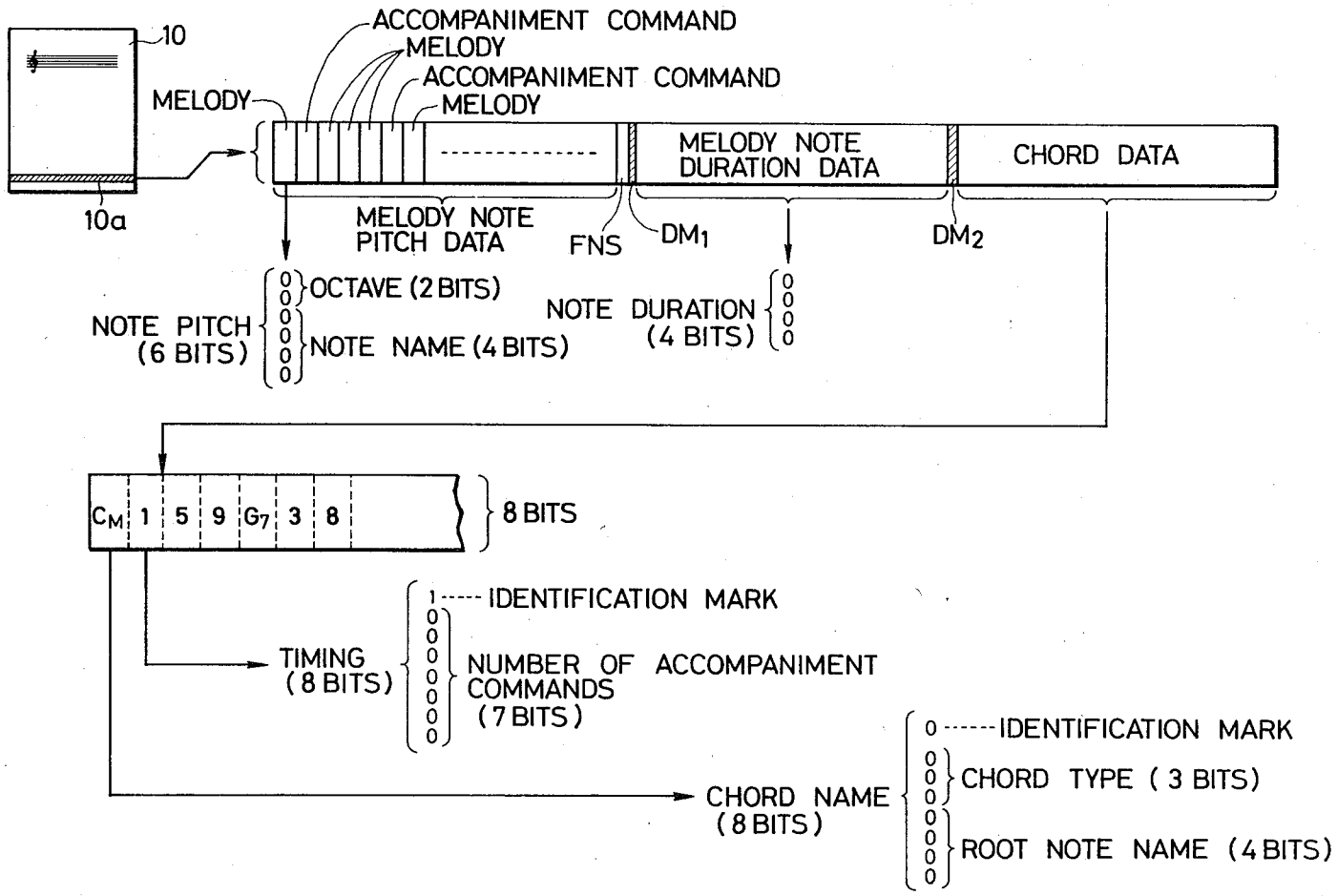

FIG. 9 shows a format of an automatic performance data which is recorded on a music sheet, according to a third embodiment of the present invention.

The format according to this third embodiment differs from the format according to the first embodiment in that an accompaniment command is contained in a melody note pitch data and that the chord timing data is set in correspondence to the number of occurrences of the accompaniment command. More particularly, the melody note pitch data is recorded on the data recording section 10*a* of the music sheet 10 in the form of containing an accompaniment command which is comprised of a 6-bit binary code "1 1 1 1 0 0" arranged at plural locations during the progression of said melody. Also, the chord data contains a chord name data and a timing data which are each comprised of an 8-bit binary code. The chord name data is such that its most significant bit is "0" serving as an identifying mark, and among the remaining 7 bits, the significant 3 bits represent a chord type and the remaining 4 bits represent a root note name, to thereby express such chord names as $C_M$ and $G_7$. The timing data, on the other hand, is such that its most significant bit is "1" serving as an identifying mark, and the remaining 7 bits are indicative of the number of occurrences of the accompaniment command such as "1", "5" and "9", to thereby express the timing of generation of a chord.

Figure 10:
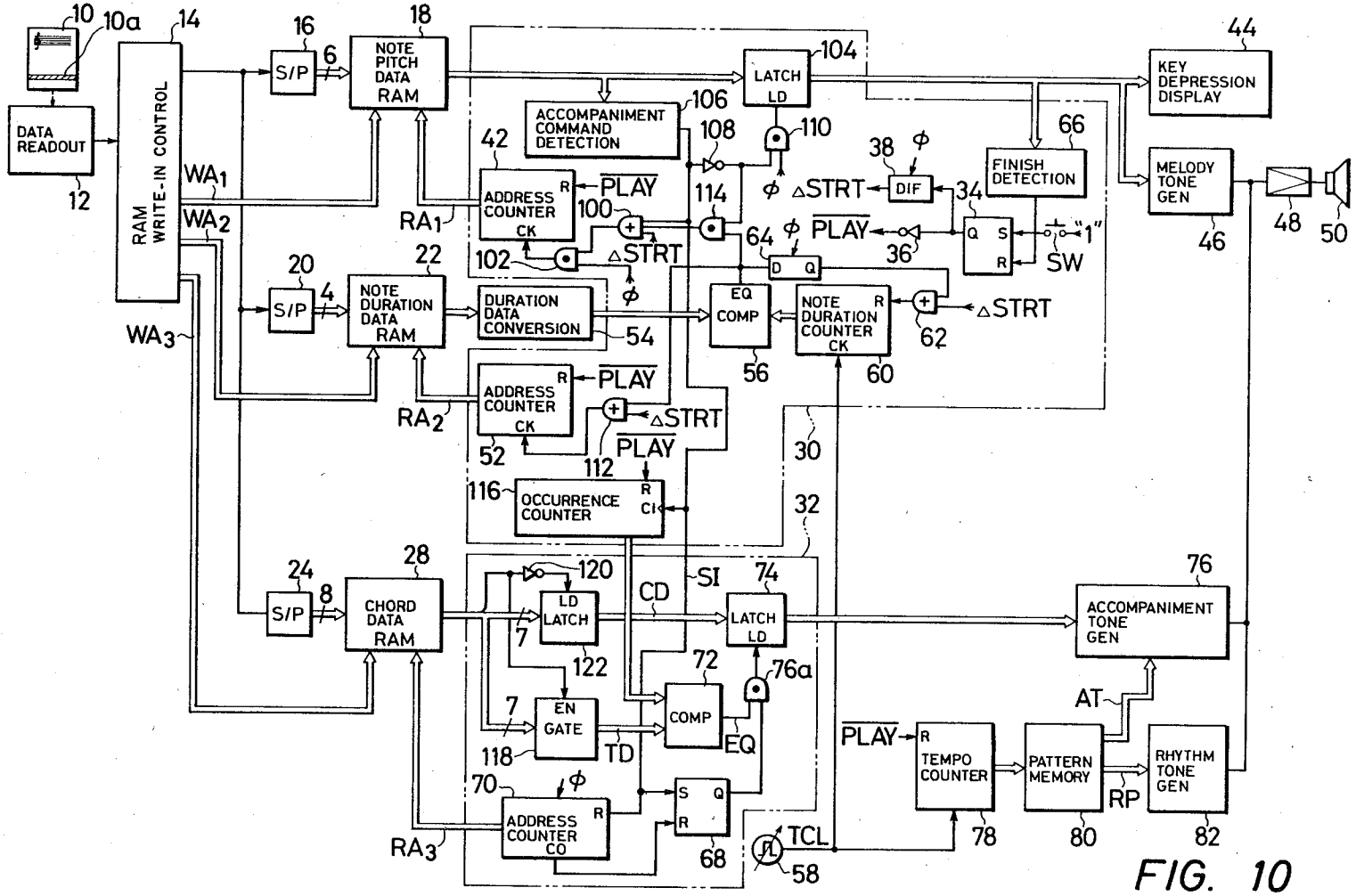

FIG. 10 shows an automatic performing apparatus utilizing the music sheet shown in FIG. 9. Like parts of FIG. 2 are given like reference numerals and symbols, to omit their detailed explanation.

The accompaniment command which is read out from the music sheet 10, like the individual melody note pitch data, is converted by an S/P converting circuit 16 to a parallel 6-bit data, and then it is stored in an RAM 18. Also, the chord data is first converted by an S/P converting circuit 24 to parallel 8-bit data, and then it is stored in a RAM 28.

When a start signal ΔSTRT is generated in a readout controlling circuit 30, this signal ΔSTRT is supplied, via an OR gate 100, to an AND gate 102. Accordingly, a clock signal $\phi$ is supplied via said AND gate 102, to a counter 42. The counter 42 is enabled to count the clock signal $\phi$ by one, and supplies a read-out address signal $RA_1$ corresponding to the first read-out address to the RAM 18. As a result, from this RAM 18 is read out a melody note pitch data corresponding to the first melody note, and this is supplied to a latching circuit 104. At such time, an accompaniment command detecting circuit 106 receiving, as its input, the read-out data of the RAM 18 delivers out an output signal="0". Accordingly, an inverter 108 receiving, as its input, this output signal supplies an output signal="1" to an AND gate 110. Then, the AND gate 110 supplies this clock signal $\phi$ to latching circuit 104 as a load signal LD. In response thereto, the latching circuit 104 latches the initial melody note pitch data delivered from the RAM 18, and supplies same to a key depression display unit 44 and to a melody sound generating circuit 46. Accordingly, the key depression displaying unit 44 displays the depressing key corresponding to the initial melody tone, and the initial melody tone is sounded from a loudspeaker 50.

On the other hand, a start signal ΔSTRT is supplied to a counter 52 via an OR gate 112. Accordingly, from a RAM 22 is read out a melody note duration data corresponding to the initial melody note, and it is supplied to a comparing circuit 56 via a duration data converting circuit 54. This comparing circuit 56 generates a coincidence signal EQ when the count value of a counter 60 reaches a value corresponding to the note duration indicated by the first melody note duration data. This coincidence signal EQ is supplied to the AND gate 102 via an AND gate 114 enabled by an output signal delivered from the inverter 108 and further through the OR gate 100. As a result, the counter 42 again counts the clock signal $\phi$ delivered from the AND gate 102. Accordingly, an initial accompaniment command is read out from the RAM 18, and it is supplied to an accompaniment command detecting circuit 106.

The accompaniment command detecting circuit 106 generates an output signal="1" in response to with initial accompaniment command. This output signal is supplied to the AND gate 102 via the OR gate 100. Accordingly, there is read out from the RAM 18 a melody note pitch data corresponding to the second melody note, and it is latched by the latching circuit 104 in the same manner as described in connection with the preceding embodiment. As a result, there is carried out an automatic performance of both the key depression display and the second melody note.

Also, the detection output from the accompaniment command detecting circuit 106 is supplied to an occurrence counter 116 which is reset by a signal $\overline{PLAY}$, and advances the count of this counter 116 by one, and on the other hand said detection output is supplied, as a search command signal SI, to a searching circuit 32. The coincidence signal EQ delivered from the comparing circuit 56 is also supplied to the counter 52 via the OR gate 112, so that there is read out from the RAM 22 a melody note duration data corresponding to the second melody note, and this is used for the determination of the note duration in the same manner as for the preceding embodiment.

By similar repetition of such data read-out operation as described above, an automatic key depression display and an automatic melody performance are accomplished. The occurrence conter 116 generates an occurrence frequency data indicative of the number of occurrences of the accompaniment command which is generated from the RAM 18, and this data is supplied, as a melody progress data, to a comparing circuit 72 of the searching circuit 32.

The searching circuit 32 reads out, at a high speed, a chord data from the RAM 28 for each generation of a search command signal SI in synchronism with the accompaniment command delivered from the RAM 18. Among the read-out data delivered from the RAM 28, the most significant bit signal is supplied, as an enable signal EN, to a gating circuit 118, and concurrently it is supplied, as a load signal LD, to a latching circuit 122 via an inverter 120. The remaining 7-bit signal serves as an input data of both the gating circuit 118 and the latching circuit 122. As stated above, the most significant bit signal represents an identifying mark, which is "0" for a chord name data, and "1" for a timing data. Accordingly, the gating circuit 118 is rendered conductive for each read-out of a timing data TD from the RAM 28, and supplies this data TD to the comparing circuit 72. Also, the latching circuit 122 latches a chord name data CD each time it is read out from the RAM 28, and supplies same to a latching circuit 74.

The comparing circuit 72 compares the occurrence frequency data delivered from the occurrence counter 116 with the timing data TD from the gating circuit 118, and each time there is a coincidence between these two kinds of data, it generates a coincidence signal EQ. This coincidence signal EQ is supplied to the latching circuit 74 via an AND gate 76, and causes the latching circuit 74 to latch a chord name data CD at such time. Let us now assume that an initial accompaniment command is read out from the RAM 18. The comparing circuit 72 generates a coincidence signal EQ when a timing data TD which is indicative of the number of occurrence "1" is read out from the RAM 28, and in response thereto, the latching circuit 74 latches a chord name data CD which indicates a chord name $C_M$. As a result, a chord tone of $C_M$ and a bass tone corresponding thereto are sounded from the loudspeaker 50.

Subsequently thereto, when a timing arrives at which the third accompaniment command is to be generated from the RAM 18, the comparing circuit 72 generates a coincidence signal EQ when a timing data TD indicative of the number of occurrence "3" of the accompaniment command is read out from the RAM 28. In response thereto, the latching circuit 74 latches a chord name data CD indicative of a chord name $G_7$. Accordingly, there are sounded from the loudspeaker 50 a chord of $G_7$ and a bass tone correponding thereto, in lieu of the chord $C_M$ and a bass tone corresponding thereto.

The above-described third embodiment differs from the first and the second embodiment in that when the searching circuit 32 carries out its read-out operation, this always results a variation of the chord which is to be sounded.

In those embodiments stated above, the data-recording sheet for use in an automatic performance has been described as being a musical score sheet. It should be understood, of course, that this may be some other kind of recording medium. Also, by arranging so that chord name data delivered from the RAM write-in controlling circuit 14 is written in the chord data RAM 28 in the order of the generation of chords, there can be read out chord name data sequentially from the RAM 28 to thereby carry out an automatic chord performance. In such instance, the operation of searching chord name data can be made unnecessary.

What is claimed is:

1. An automatic performing apparatus, comprising:

a recording medium carrying a record of chord data comprising chord name data indicative of a particular chord name included in a music composition and associated timing data indicative of plural different imings of generation of said particular chord during a progression of said music compositon, said chord name data being carried on said medium only once for all of said plural different generations of said particular chord;

read-out means for reading out said chord name data and said timing data from said recording medium;

chord name data supplying means for receiving said chord name data and said timing data from said read-out means and for delivering out said chord name data at each of the plural timings specified by said timing data; and accompaniment tone generating means for generating an accompaniment tone signal based on the chord name data each time that said chord name data is delivered out from said supplying means.

2. An automatic performing apparatus according to claim 1, in which:

said chord name data supplying means comprises:

first memory means;

write-in means for writing in said first memory means said chord name data and said timing data delivered from said read-out means; and searching for reading out, from said first memory means, said chord name data and said timing data at each possible timing of chord generation during the music progression and for searching out a chord name data having associated therewith a timing data corresponding to said each chord generation timing.

3. An automatic performing apparatus according to claim 2, further comprising:

data generating means for generating progression data indicative of progression timing of said music composition and including search commanding means for generating a search command signal to said searching means for each occurrence of said progression data.

4. An automatic performing apparatus according to claim 3, in which:

said searching means reads out recorded data from said first memory means at each generation of said search command signal, and compares said timing data with said progression data, and picks up chord name data corresponding to said timing data at each occurrence of coincidence between said timing data and said progression data.

5. An automatic performing apparatus according to claim 4, in which:

said recording medium further carries melody data in accordance with a progression of said musical composition; and said data generating means generates said melody data as said progression data.

6. An automatic performing apparatus according to claim 5, in which:

said data generating means comprises:

said read-out means for reading out said melody data from said recording medium;

second memory means for storing said melody data delivered from said read-out means;

said write-in means for writing in said second memory means said melody data delivered from said read-out means; and melody data supplying means for reading out sequentially said melody data stored in said second memory means, and for generating the read-out melody data as said progression data.

7. An automatic performing apparatus according to claim 6, in which:

said search commanding means generates a search command signal in synchronism with a read-out timing of said melody data.

8. An automatic performing apparatus according to claim 6, in which:

said melody data comprises melody note pitch data and melody note duration data;

said search commanding means compares said melody note duration data with an output of counting means assigned to count a tempo clock signal delivered from a tempo clock supply, and uses the result of the comparison as said search command signal.

9. An automatic performing apparatus according to claim 6, in which:

said timing data and said progression data each comprises data corresponding to an address location of said melody data in said second memory means.

10. An automatic performing apparatus according to claim 4, in which:

said timing data is comprised of data corresponding to a measure number and a beat number which collaborate to specify a specific timing during the music progression; and said data generating means comprises:

tempo clock supply for generating a tempo clock signal establishing the music progression; and counting means counting said tempo clock signal for generating a measure count value and a beat count value together as said progression data.

11. An automatic performing apparatus according to claim 5, in which:

said melody data contains an accompaniment command in correspondence to each possible timing of chord generation during the melody progression;

said timing data is comprised of data corresponding to the number of occurrences of said accompaniment command; and said data generating means includes counting means to count said accompaniment command to produce a count output as said progression data.

12. A recording medium for use in an automatic performing apparatus to carry out an automatic chord performance in accordance with a progression of a music composition, carrying the following functional elements:

a chord data zone, comprising:

a plurality of spaced chord name data regions each containing chord name data indicative of the name of a respective chord included in said music composition; and between each two spaced chord name data regions, a plurality of chord timing zones associated with the chord name data specified in the continuous chord name data region, each timing zone having timing data indicative of a respective one of plural different timings of generation of that particular chord during the progression of said music composition.

13. A recording medium according to claim 12, in which:

said timing data is comprised of coded data indicative of measure number and beat number provided in said music composition.

14. A recording medium according to claim 12, further carrying a following record:

melody data recorded in correspondence to the progression of said music composition.

15. A recording medium according to claim 14, in which:

said timing data is indicative, by designating specific one or ones of said melody data together which a chord is generated, of different timings of generation of said chord during the progression of said music composition.

16. A recording medium according to claim 14, in which:

said timing data is comprised of coded data representing address information of said melody data to read out the melody data from a memory provided in said automatic performing apparatus, said melody data being read out by said address information in accordance with the progression of said melody.

17. A recording medium according to claim 14, in which:

said melody data contains accompaniment command corresponding to a plurality of locations of progression of said music composition; and said timing data is comprised of coded data indicative of occurrence number of said accompaniment command.

18. A recording medium according to claim 14, in which:

said melody data is comprised of melody note pitch data and melody note duration data.

19. A recording medium for use in an automatic performing apparatus to carry out an automatic chord performance in accordance with a progression of a music composition, carrying the following records:

chord data, comprising:

chord name data indicative of the names of each chord included in said music composition; and associated with the chord name data for each particular chord, timing data indicative of plural different timings of generation of that particular chord during the progression of said music composition, and wherein:

chord name data for a particular chord name is carried on said recording medium only once regardless of the total number of generations of that particular chord during said performance.

20. A recording medium for use with an automatic music performing apparatus, said recording medium comprising:

an elongated recording medium strip, there being situated on said strip;

a plurality of contiguous zones along said medium strip, each of said zones having a first region containing machine readable indicia in the form of chord name data specifying the name of a chord, and a set of adjacent second regions each containing machine readable indicia in the form of timing data specifying a respective one of one or more occurrence timings in a musical performance of a chord having the chord name specified in said first region, said contiguous zones being spaced along said medium for sequential machine readability.

21. A recording medium according to claim 20, in which:

said chord name data is comprised of a code indicative of a discrimination mark, a code indicative of a chord type and a code indicative of a root note of a chord, and said timing data is comprised of a code indicative of a discrimination mark and a code indicative of timing.

22. A recording medium according to claim 21, in which:

said chord name data is comprised of ten-bit code, of which four bits are used as a code indicative of a discrimination mark, two bits as a code indicative of a chord type, and remainder four bits as a code indicative of a root note of a chord; and said timing data is comprised of ten-bit code, of which four bits is used as a code indicative of a discrimination mark, and remainder six bits as a code indicative of timing.

23. A recording medium according to claim 21, in which:

said chord name data is comprised of nine-bit code, of which one bit is used as a code indicative of a discrimination mark, four bits as a code indicative of a chord type, and remainder four bits as a code indicative of a root note of a chord; and said timing data is comprised of nine-bit code, of which one bit is used as a code indicative of a discrimination mark, six bits as a timing code indicative of measure number of said music composition, and remainder two bits as a timing cord indicative of beat number of said music composition.

24. A recording medium according to claim 21, in which:

said chord name data is comprised of eight-bit code, of which one bit is used as a discrimination mark, three bits as a code indicative of a chord type, and remainder four bits as a code indicative of a root note of a chord; and said timing data is comprised of eight-bit code, of which one bit is used as a discrimination code, and remainder seven bits as a timing code indicative of number of occurrence of said accompaniment command.

25. An elongated recording medium adapted for use in an automatic music performing apparats, said elongated medium comprising a first zone storing machine readable indicia specifying melody note pitch data for a musical performance, followed by a second zone containing machine readable indicia specifying melody note duration, and thereafter a plurality of third zones sequentially spaced along said elongated medium, each of said third zones containing a first region having machine readable indicia specifying the name of a chord, and thereafter a set of plural regions each containing machine readable indicia specifying respective plural occurrence timings in said musical performance of a chord of the specified chord name.

26. A recording medium according to claim 25 further including machine readable demarcation data containing zones situated between said first and second zones and between said second zone and the beginning of said plurality of third zones.

* * * * *

UNITED STATES PATENT AND TRADEMARK OFFICE

CERTIFICATE OF CORRECTION

PATENT NO. : 4,587,878

DATED : May 13, 1986

INVENTOR(S) : Akira Nakada; Takatoshi Okumura; Kotaro Mizuno

It is certified that error appears in the above-identified patent and that said Letters Patent is hereby corrected as shown below:

Column 12, line 26, change "imings" to --timings--.

Column 12, line 49, change "searching for" to --searching means for--.

Column 14, line 13, change "continuous" to --contiguous--.

Signed and Sealed this

Twenty-first Day of October, 1986

[SEAL]

*Attest:*

DONALD J. QUIGG

*Attesting Officer* *Commissioner of Patents and Trademarks*